United States Patent [19]

Brecker et al.

[11] Patent Number: 4,579,672

[45] Date of Patent: Apr. 1, 1986

[54] FUNCTIONAL FLUIDS AND LUBRICANTS HAVING IMPROVED WATER TOLERANCE

[75] Inventors: Lawrence R. Brecker, Brooklyn, N.Y.; Otto E. Loeffler, Woodbridge, N.J.; Charles Abramoff, New York, N.Y.; William K. Cleveland, Roselle; Susan J. Wosatka, Linden, both of N.J.

[73] Assignees: Exxon Research & Engineering Co., Florham Park, N.J.; Argus Chemical Corporation, Brooklyn, N.Y.

[21] Appl. No.: 612,666

[22] Filed: May 21, 1984

Related U.S. Application Data

[63] Continuation-in-part of Ser. No. 493,398, May 10, 1983, abandoned.

[51] Int. Cl.[4] ..... C10M 1/44

[52] U.S. Cl. ..... 252/49.8; 252/78.5

[58] Field of Search ..... 252/49.8, 78.5

[56] References Cited

U.S. PATENT DOCUMENTS

| | | | |
|---|---|---|---|
| 2,750,342 | 6/1956 | Mikeska et al. | 252/46.6 |
| 2,856,369 | 10/1958 | Smith et al. | 252/49.8 X |
| 3,010,903 | 11/1961 | Clarke et al. | 252/49.8 X |
| 3,088,917 | 5/1963 | Friedman et al. | 252/49.8 X |
| 3,152,164 | 10/1964 | Oswald | 252/49.8 X |
| 3,340,191 | 9/1967 | White et al. | 252/49.8 X |
| 3,346,670 | 10/1967 | Papalos | 252/49.8 X |
| 3,547,820 | 12/1970 | Woodward et al. | 252/49.8 X |
| 3,626,035 | 12/1971 | Ernst | 252/49.8 X |

*Primary Examiner*—Patrick P. Garvin

*Attorney, Agent, or Firm*—J. J. Mahon; R. A. Maggio

[57] ABSTRACT

There are disclosed functional fluids and lubricating compositions containing a minor amount of an oil-soluble alkoxypolyethyleneoxy acid phosphite ester additive which provides improved water tolerance properties to the compositions.

16 Claims, No Drawings

FUNCTIONAL FLUIDS AND LUBRICANTS HAVING IMPROVED WATER TOLERANCE

CROSS-REFERENCE TO RELATED APPLICATIONS

This application is a continuation-in-part of U.S. Ser. No. 493,398, filed May 10, 1983 and now abandoned.

This invention relates to functional fluids and lubricants which exhibit improved water tolerance properties. More particularly, the invention relates to mineral oil or synthetic oil based functional fluid compositions which contain effective amounts of certain oil-soluble, alkoxypolyethyleneoxy mono- or di-acid phosphite ester additives, which additives are highly effective in improving the water tolerance properties of such compositions.

U.S. Pat. No. 2,280,450 describes hydrocarbon oils of improved resistance to corrosion containing a small amount of a substantially stable oil-soluble water-insoluble reaction product of tricresyl phosphte and octyl phenoxyethanol. The mole ratio of tricresyl phosphite to octyl phenoxyethanol varies from 1:1 to about 1:2.5. The reaction product is described as a complex ester of phosphorous acid, which may or may not contain unreacted octyl phenoxyethanol. The product is not however an acid phosphite, and it is not suggested that the water tolerance of the resulting composition is improved.

U.S. Pat. No. 3,583,915 provides industrial fluid compositions and lubricant compositions containing improved load-carrying additives, including a diorgano hydrogen phosphonate in which at least one organic group is an aliphatic group containing at least fourteen carbon atoms in admixture with an active sulfur compound.

U.S. Pat. No. 3,652,410 provides multifunctional lubricant additive compositions and lubricating oils containing, among other things, an organic acid phosphate or organic phosphite containing at least one alkyl or alkenyl group having from about 12 to about 24 carbon atoms. Also present is a mineral oil soluble or dispersible basic detergent, a mineral oil antioxidant, a sulfurized fat, or an alkyl sulfide or alkyl polysulfide.

U.S. Pat. No. 4,346,148 and U.S. Pat. No. 4,358,509 describe reaction products of alkoxylated alkyl phenol and a phosphorus trihalide which are included in lubricating compositions useful in metal-working operations, imparting corrosion resistance, extreme pressure properties, and protection against wear of working parts.

U.S. Pat. No. 3,115,465 provides antioxidant combinations for organic materials, including lubricants, comprising an oil-soluble phosphite ester having the formula:

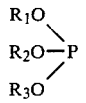

wherein $R_1$ and $R_2$ are alkyl, alkoxyalkyl, haloalkyl, cycloalkyl, halocycloalkyl, aralkyl, aryl, alkaryl, haloaryl or haloalkaryl radicals and $R_3$ is hydrogen or one of the aforesaid radicals; and from about 0.01 to about 5, preferably 0.25 to 2%, by weight based on the oil of a methylene bis-phenol having the formula:

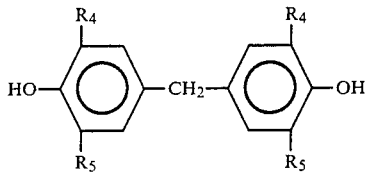

wherein $R_4$ is an alkyl grouop containing 3 to 12 carbon atoms, the group being branched on its alpha carbon atom, and $R_5$ is an alkyl group of 1 to 12 carbon atoms.

None of the foregoing references disclose the improvement in water tolerance properties achieved in accordance with the present invention. Water compatibility is a highly significant property of functional fluids and lubricants, which, under severe conditions, come into contact with water and in the absence of acceptable water tolerance properties the fluid will have its lubricating and power transmission properties substantially reduced. The specifications of many equipment manufacturers require that the fluids and lubricants used therein have certain water tolerance properties, for example, fluids for use in agricultural machinery, such as tractor fluids.

In accordance with the present invention there have been discovered improved functional fluids and lubricating compositions comprising a major amount of a synthetic or mineral oil of lubricating viscosity and an amount, effective to improve the water tolerance properties of the composition, of an oil-soluble alkoxypolyethyleneoxy acid phosphite ester additive of the formula:

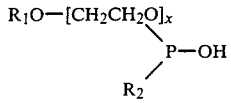

wherein:

$R_1$ is alkyl or alkenyl and $R_2$ is OH, alkoxy, oxy-alkenyl, or $R_1O[CH_2CH_2O]_x$, in which the total number of carbon atoms in the alkyl, alkenyl alkoxy or oxyalkenyl groups is about 8 to 36; and x is a number (which can be a whole number or a fractional number) representing the average number of $[CH_2CH_2O]$ groups, and ranges from about 2 to about 4. Preferred phosphite additives are those wherein x is 2, 2.5, 3.5 or 4.

In $R_1$ and $R_2$, the alkyl and alkenyl groups include octyl, 2-ethyl hexyl, isooctyl, tertiary-octyl, nonyl, isononyl, tertiary-nonyl, secondary-nonyl, decyl, isodecyl, undecyl, dodecyl, tridecyl, palmityl, stearyl, and isostearyl; octenyl, nonenyl, decenyl, dodecenyl, oleyl, linoleyl and linolenyl.

Acid phosphites according to the invention include di(octyl di(ethyleneoxy)) phosphite, di(isooctyl tri-(ethyleneoxy)) phosphite, di(2-ethylhexyl-tetra(ethyleneoxy)) phosphite, di(nonyl-di(ethyleneoxy)) phosphite, di(isodecyl-tri(ethyleneoxy)) phosphite, di(palmityl-tetra(ethyleneoxy)) phosphite, di(stearyl tri(ethyleneoxy)) phosphite, octyl di(ethyleneoxy) phosphite, stearyl di(ethyleneoxy) phosphite, and octyl(tri(ethyleneoxy))nonyl(tetra(ethyleneoxy)) phosphite; octyl di(ethyeneoxy))octyl phosphite, isooctyl tri-(ethyleneoxy) oleyl phosphite, 2-ethylhexyl-tetra(ethyleneoxy) decyl phosphite, nonyl-di(ethyleneoxy) nonyl phosphite, isodecyl-tri(ethyleneoxy) linoleyl phosphite, palmityl-tetra(ethyleneoxy) stearyl phosphite, stearyl-tri(ethyleneoxy) stearyl phosphite, octyl di(ethyleneoxy) stearyl phosphite, stearyl di(ethyleneoxy) oleyl phosphite, and octyl tri(ethyleneoxy) nonyl phosphite.

The oil-soluble phosphite ester additive of this invention will provide effective water tolerance properties to a wide variety of functional fluid and lubricating compositions and these include hydraulic fluids, compressor oils, pump oils, tractor fluids and universal tractor fluid compositions, gear oils, hydrostatic transmission oils, power shift transmission fluids and the like. Such functional fluids and lubricating compositions will also contain a number of conventional additives in amounts as required to provide their normal attendant functions. Such additives include viscosity modifiers or viscosity index improvers, corrosion inhibitors, oxidation inhibitors, friction modifiers, dispersants, demulsifiers, anti-foam agents, anti-wear agents, pour point depressants, seal swellants and other special purpose additives.

Typical viscosity modifiers include, polyisobutylene, ethylene-propylene copolymers, polymethacrylates, styrene-acrylic ester copolymers and vinyl monomer unsaturated dicarboxylic acid (or ester) copolymers. Corrosion inhibitors include zinc dialkyl dithiophosphates and phosphosulfurized hydrocarbons and reaction products thereof with alkaline earth metal oxides or hydroxides, preferably in the presence of alkyl phenols or alkyl pehnol thioethers. Oxidation inhibitors are ilustrated by alkaline earth metal salt of alkyl ($C_5$–$C_{12}$) phenol thioethers.

Dispersants are well known in the art and include oil soluble alkyl succinates and the reaction products of polyisobutylene succinic anhydrides with ethylene amines and borated derivatives. Exemplary pour point depressants are $C_8$–$C_{18}$ dialkylfumarate vinyl acetate copolymers, polymethacrylates and wax naphthalene condensation products. Anti-foam agents are typically polysiloxane materials such as silicone oil and polydimethyl siloxane anti-wear agents include zinc dialkyl (or diaryl) dithiophosphates and magnesium sulfonates. Seal swellants are typified by mineral oils that provoke swelling, $C_8$–$C_{13}$ aliphatic alcohols and $C_{10}$–$C_{60}$ hydrocarbon esters having 2–4 ester linkages such as dihexylphthalate.

The oil-soluble phosphite ester additive of this invention will be present in amounts effective to provide acceptable water tolerance properties to the particular composition and the desired amount will vary according to the service conditions but generally the additives of this invention will be present in an amount of about 0.05 to 5% by weight, based on the weight of the total lubricating oil or functional fluid composition and preferably from about 0.2 to 2% by weight percent.

Typical base oils for such functional fluids and lubricating compositions include a wide variety of hydrocarbon mineral oils such as naphthene base, paraffin base and mixtures thereof having a lubricating viscosity range of about 34 to 45 Saybolt Universal Seconds (SUS) at 35° C. Examples of synthetic oils useful in the compositions of the present invention include olefin oligomers, alkylated aromatics, polybutene oils, cycloaliphatic compounds, dibasic acid esters, polyol esters, polyglycerol fluids, phosphate esters, silicone oils and halogenated hydrocarbon fluids and mixtures thereof.

The following examples illustrate the preferred embodiments of the oil soluble phosphite ester additives of this invention: (EO refers to ethylene oxide).

EXAMPLE I

Di($C_9$–$C_{11}$ alkyl 2.5 EO) phosphite 159.8 g of triphenyl phosphite (97%) and 405 g of (mixed alkyl(oxyethylene)$_{2.5}$ alcohols, the alkyl having from nine to eleven carbon atoms, and 0.6 g of $K_2CO_3$ were heated at 85° C. for three hours. Vacuum was then applied (6 mm) with heating to a maximum temperature of 170° C. to remove phenol. The weight of volatiles collected was 150.9 g (theory 145.8). To the transesterified product 15.63 g of phosphorous acid was added with agitation and the mixture heated to 85° C. for 5 hours with agitation, giving clear reaction product having the formula:

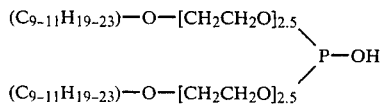

EXAMPLE II

Di($C_{12}$–$C_{15}$ alkyl-3EO) phosphite was prepared from triphenyl phosphite (97), and (mixed alkyl(oxyethylene)$_3$ alcohols, the alkyl having from eleven to fifteen carbon atoms)using the procedure of Example I. The compound has the formula:

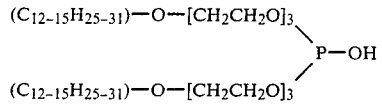

CONTROL A

Di($C_{12}$–$C_{15}$ alkyl-7EO) phosphite was prepared from triphenyl phosphite (97%), and mixed $C_{12}$–$C_{15}$ (oxyethylene)$_7$ alcohols using the procedure of Example I. The compound has the formula:

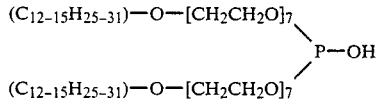

CONTROL B

Ethoxylated nonyl phenol (9.5EO) phosphite was prepared from triphenyl phosphite and ethoxylated nonylphenol using the procedure of Example I. The compound has the formula:

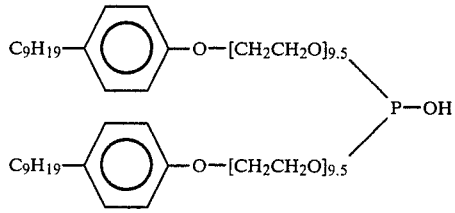

EXAMPLE III

Mono($C_{9-11}$ alkyl 2.5EO) mono oleyl phosphite was prepared from triphenyl phosphite ((mixed alkyl oxyethylene)$_{2.5}$ alcohols, the alkyl having from nine to eleven carbon atoms), and oleyl alcohol using the procedure of Example I. The compound has the formula:

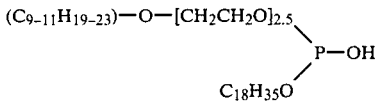

Typical functional fluids or lubricating composition of the present invention will contain a number of conventional additives in typical amounts as required to provide their normal attendant functions. Such additive components and their usual ranges are set forth below.

| Component | Concentration Range (Vol. %) |
|---|---|
| V.I. Improver | 1–15 |
| Corrosion Inhibitor | 0.01–2 |
| Oxidation Inhibitor | 0.01–2 |
| Dispersant | 0.2–10 |
| Pour Point Depressant | 0.01–1 |
| Anti-foam Agent | 0.001–0.1 |
| Anti-wear Agent | 0.01–5 |
| Seal Swellant | 0.01–1 |
| Friction Modifier | 0.1–5 |
| Mineral Oil Base | Balance |

The foregoing composition is referred to as Base Fluid and a tractor hydraulic fluid corresponding to the Base Fluid was evaluated for water tolerance with various additives as set forth below. The mineral oil used in the Base Fluid had a kinematic vicosity of 69.8 centistokes at 37.8° C. and 14.5 centistokes at 98.9° C.

The test used was the International Harvester Water Tolerance Test IH BT-7; January, 1980 contained in the International Harvester Engineering Materials Specification for Combination Hydraulic and Transmission Fluid.

The test is described as follows:

APPARATUS REQUIRED (1) Mechanical paint shaker, Red Devil No. 30 or equivalent.
(2) 118 ml bottle with cap.
(3) Graduated cylinder, 100 ml.
(4) 100 ml centrifuge tube according to ASTM Designation D 2273-67.
(5) Pipette or syringe capable of delivering 1.0 ml.
(6) Stopper to fit centrifuge tube.

PROCEDURE (1) Add 1 ml distilled water to 99 ml hydrocarbon oil in the 118 ml bottle.
(2) Shake the prepared sample for 5 minutes in the mechanical shaker.
(3) Transfer immediately to the 100 ml centrifuge tube.
(4) Stopper and let the agitated solutions stand undisturbed in a vertical position for 168 hours (7 days at 70° to 80° F., 21° to 27° C.), then examine for emulsion, water, clearness and sediment.

REPORT (1) Level of emulsion, water and settlements to the nearest 0.1 ml.
(2) The clearness or turbidity of the solution.

EXAMPLE IV

The results of evaluations are tabulated below in the Table. The data include comparisons with Control A, Control B and two commercially available Surfactants A (sorbitan oleate) and B (ethoxylated fatty acid ester of sorbitol anhydride). All additives were employed in the same Base Fluid at concentration of 1% by weight.

TABLE

| | Water Tolerance Results | | | | | | |
|---|---|---|---|---|---|---|---|
| | Additive | | | | | | |
| Tests Results | None | Ex I | Ex II | Control A | Control B | Surfactant A | Surfactant B |
| $H_2O$ | 0.2 | 0 | 0 | 1–2.5 | * | 0.45 | 3.4 |
| Interface | 0.5 | 0 | 0 | * | * | 0 | 0 |
| Oil Appearance | Haze | clear | Clear | Haze | Haze | Clear | Haze |

*Emulsions, sediment and haze present

Note:

The test is unsatisfactory if the total ml of $H_2O$ and interface is 0.2 or greater. The oil appearance should be clear and free of haze.

What is claimed is:

1. A composition adapted for use as a functional fluid or lubricating composition comprising a major amount of a synthetic or mineral oil of lubricating viscosity and an amount, effective to improve the water tolerance properties of the composition, of an oil soluble phosphite ester additive of the formula:

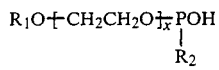

wherein:

$R_1$ is alkyl or alkenyl; and $R_2$ is OH, alkoxy, oxyalkenyl or

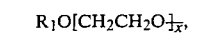

in which the total number of carbon atoms in the alkyl, alkenyl, alkoxy or oxyalkenyl groups is about 8 to 36, and x is a number representing the average number of

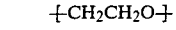

groups and is within the range from about 2 to about 4.

2. A composition according to claim 1 in which x is 2.

3. A composition according to claim 1 in which x is 2.5.

4. A composition according to claim 1 in which x is 3.

5. A composition according to claim 1 in which x is 3.5.

6. A composition according to claim 1 in which x is 4.

7. A composition according to claim 1 in which $R_1$ is alkyl having from nine to eleven carbon atoms.

8. A composition according to claim 1 in which $R_1$ is alkyl having from twelve to fifteen carbon atoms.

9. A composition according to claim 1 in which the phosphite ester is

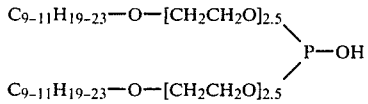

and the oil is a hydrocarbon mineral oil.

10. A composition according to claim 1 in which the phosphite ester is

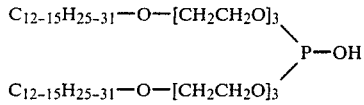

and the oil is a hydrocarbon mineral oil.

11. A composition according to claim 1 in which the phosphite ester is

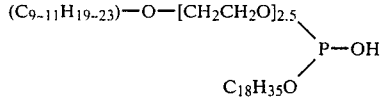

12. A composition according to claim 1 in which the amount of the additive is within the range from about 0.05 to about 5% by weight of the oil.

13. A hydrocarbon oil composition according to claim 1 in which the amount of the additive is within the range from about 0.2 to about 2% by weight of the oil.

14. The composition of claim 1 adapted for use as a tractor fluid.

15. The composition of claim 1 adapted for use as a functional fluid.

16. The composition of claim 1 adapted for use as a lubricating composition.

* * * * *